US005167929A

United States Patent [19]

Korf et al.

[11] Patent Number: 5,167,929

[45] Date of Patent: Dec. 1, 1992

[54] REACTION VESSEL FOR RECEIVING MINIMAL QUANTITIES OF FLUID SAMPLES

[75] Inventors: Dieter Korf, Winterborn; Dagmar Flach, Gummersbach; Stephan Diekmann, Göttingen, all of Fed. Rep. of Germany

[73] Assignee: Walter Sarstedt Geraete und Verbrauchsmaterial fuer Medizin und Wissenshaft, Nuembrecht-Rommelsdorf, Fed. Rep. of Germany

[21] Appl. No.: 466,359

[22] PCT Filed: Jul. 7, 1989

[86] PCT No.: PCT/EP89/00786

§ 371 Date: Apr. 6, 1990

§ 102(e) Date: Apr. 6, 1990

[87] PCT Pub. No.: WO90/00442

PCT Pub. Date: Jan. 25, 1990

[51] Int. Cl.[5] ..... B01L 3/00

[52] U.S. Cl. ..... 422/102; 422/104; 220/410

[58] Field of Search ..... 422/102, 104; 73/863.11, 863.12; 210/787, 175; 220/410, 429

[56] References Cited

U.S. PATENT DOCUMENTS 4,599,315 7/1986 Terasaki et al. ..... 435/301
4,683,058 7/1987 Lyman et al. ..... 210/359

FOREIGN PATENT DOCUMENTS 0245994 11/1987 European Pat. Off. .
330179 7/1958 Fed. Rep. of Germany .
83/00386 2/1983 PCT Int'l Appl. .

*Primary Examiner*—Robert J. Warden
*Assistant Examiner*—Laura E. Collins
*Attorney, Agent, or Firm*—Townsend & Townsend

[57] ABSTRACT

In accordance with the invention, a method for executing reactions at temperatures exceeding 50° C. is disclosed using minimal quantities of fluid samples. The method uses a reaction vessel which minimizes the containment space for the fluid sample. The reaction vessel includes a sample-receiving tube and an insert. The insert engages the sample-receiving tube, forming a seal and prevents evaporation of the fluid sample during heating. The sample-receiving tube of the method is tapered to be narrow towards the bottom so that the insert can be easily inserted into the sample-receiving tube from the top and provide a tight seal in the lower extremity without increasing pressure in the reaction chamber. Equalization between the two sides of the sealing insert can occur as the insert is being introduced. Minimal displacement of the insert in the axial direction of the sample-receiving tube produces a sealing connection minimizing undesirable pressure build up.

7 Claims, 2 Drawing Sheets

REACTION VESSEL FOR RECEIVING MINIMAL QUANTITIES OF FLUID SAMPLES

BACKGROUND OF THE INVENTION

The invention relates to a reaction vessel for receiving minimal quantities of fluid samples.

In particular, molecularbiological work often calls for reactions at temperatures exceeding 50° C. (thru 100° C.) as in the high-temperature inactivation of proteins, denaturing nuclein acids, restrictional digestion with Taq I and the like. These reactions are usually carried out in standard reaction vessels placed in preheated water baths or in holes drilled heated metal blocks. The volumes of the reaction solutions are normally in the range 10 and 50 μl, the volumes of the reaction vessels between 1000 and 2500 μl. The reaction vessels thus contain a large excess volume, in which water evaporates from the reaction solutions and is deposited on the inside of the cover. This increases the concentrations in the reaction solution, sometimes to the extent that the sample completely dries out. This is greatly obstructive to the tests and treatments involved and can only be avoided by special measures such as, for instance, repeated centrifuging of the reaction vessels or coating the reaction solution with oil.

OBJECT OF THE INVENTION

The object of the invention is to create a reaction vessel of the aforementioned type in which the gas volume in a reaction vessel filled with a reaction solution is reduced to such an extent that evaporation of the reaction solution into larger spaces located above is no longer possible, thus effectively preventing drying out of the sample in heat treatment.

One aspect of the invention is to reduce the volume for the sample in the reaction vessel with an insert to such an extent that the space for evaporation above the sample is configured as small as possible to accordingly limitate evaporation of the fluid from the sample.

A further aspect of the invention is to configure a seal active on all sides by arranging said insert as tight as possible above the sample located in the sample-receiving tube so that the remaining volume above the sealed off area is isolated gas-tight from the actual reaction chamber in which the sample is located. In this way any resulting vapor is restricted to the resulting, comparitively small reaction chamber.

A substantial problem is posed by configuring the seal between the insert and the sample-receiving tube so that when the insert is pushed into the sample-receiving tube little or no pressure is built up in the reaction chamber. This is important, for one thing, because otherwise pushing the insert into the sample-receiving tube is only possible by considerable exertion, and, for another thing, buildup of pressure in the reaction chamber could be detrimental to the sample or to the tests to be carried out.

To permit isolating a relatively small reaction chamber in the area of the lower extremity of the sample-receiving tube without any tangible pressure build-up in the reaction chamber when pushing the insert into the sample-receiving tube a seal is formed only after the insert is at its terminal position.

Since the cross-section of the sample-receiving tube is larger above the sealing area in the lower extremity than at this extremity, the insert can be pushed into the sample-receiving tube from the top by its sealing lower extremity or by the sealing element provided at its lower extremity without causing pressure to build up, because a gap permitting pressure equalization remains between the periphery of the sealing area or sealing element and the internal wall of the sample-receiving tube. It is not until the sealing area or the sealing element comes into contact with the area of the reduced cross-section that the sealing connection is momentarily produced, i.e. with minimal displacement of the insert in the axial direction. Thus, there is practically no build-up of pressure within the reaction chamber. Whilst the insert may be formed very voluminous which is particularly useful in the embodiment having no seal at the lower extremity of the insert, an embodiment employing a relatively thin rod is preferred because here very little material is required for the insert, it merely serving as a carrier and pressure transfer element for the sealing element provided at its lower extremity, said sealing element having sealing contact with the interior wall of the sample-receiving tube.

By releasably attaching the insert to the lid, the separate reaction vessel can be used either with or without insert, as required.

The insert can also be replaced so that, for example, inserts of differing length and with differing sealing elements at the lower extremity can be used, with which reaction chambers of differing size can be separated from the remaining volume.

Particularly when sealing the reaction chamber in the area of the lower extremity of the insert, venting of the lid is useful to prevent any build-up of pressure in the remaining volume.

BRIEF DESCRIPTION OF THE DRAWINGS

The invention will now be described by way of example with reference to the following Figures, wherein.

DETAILED DESCRIPTION OF THE PREFERRED EMBODIMENT

Figure 1:
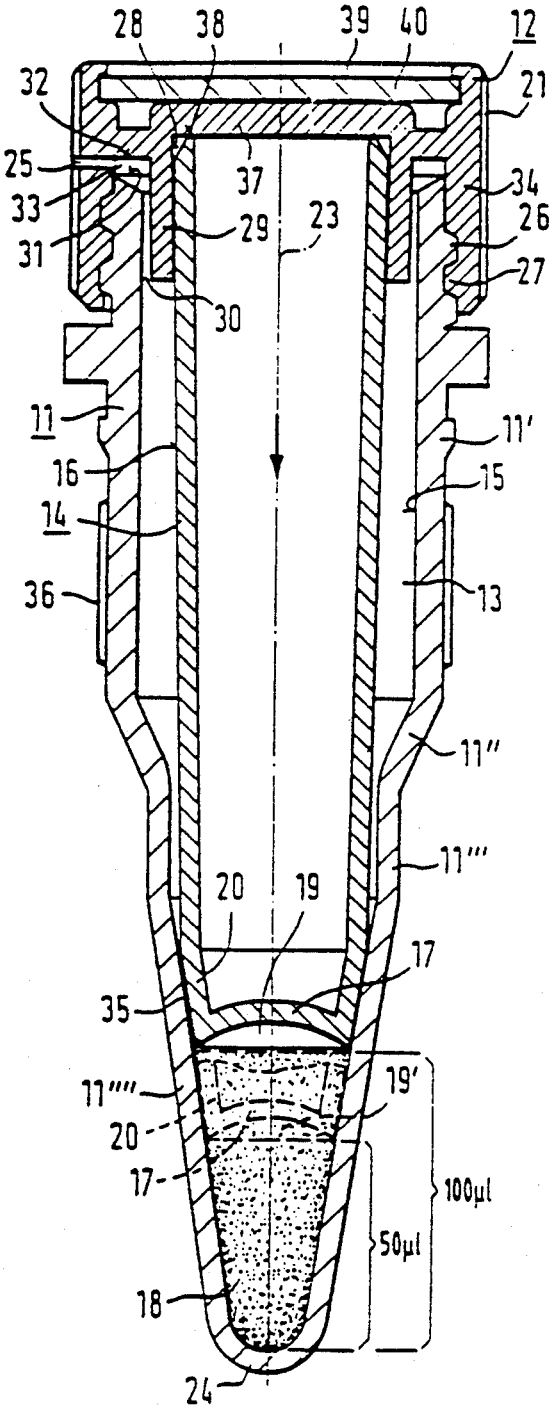
FIG. 1 is vertical, longitudinal section through the center of a reaction vessel according to a first embodiment of the invention.

According to FIG. 1 sample-receiving tube 11 having a circular cross-section features above a rounded tip 24 a conical section 11'''' extending upwards, followed by a relatively short cylindrical section 11''', topped by a short extension section 11'' and completed by a top cylindrical section 11' which is relatively long and has the largest diameter relative to the other sections.

At the top of the exterior wall of the sample-receiving tube 11*a* male thread 26 designed to mate with the female thread 27 of the screw-on lid 12 is provided. On its inside the lid 12 has a circular-cylindrical recess 28 which is open towards the bottom, located concentrically to the centerline 23 and in which a hollow-cylindrical insert 14 is inserted from underneath as a sliding fit, or better, as a seized fit. Basically the insert 14 could just as well be secured in the recess 28 also by using a suitable fastener such as an adhesive, for example. However, the insert 14 is preferably provided for withdrawing when the lid 12 is unscrewed, thus facilitated replacement.

The circumferential flange 29 forming the recess 28 features a radially outwards directed slight spacing 30 from the interior wall 15 of the sample receiving tube 11 so that between the top end of the wall 31 and a bottom annular wall 32 of lid 12 when screwed fully in place a clearance 33 remains which borders on a side vent opening 25 in the threaded circumferential edge 34 of the lid 12. In this way pressure compensation is possible between the interior space 13 of the sample-receiving tube 11 and atmosphere.

A hollow cylindrical insert 14 has a slightly smaller outer diameter than the circular-cylindrical section 11''' and changes at its lower extremity into a extremity section 20 which is slightly conical in taper downwards, at the lower extremity of which the insert 14 is closed off by a bottom wall 17.

The conical extremity section 20 has a seal contact 35 with the interior wall 15 of the sample-receiving tube 11 within the section 11'''' when lid 12 is screwed in place as shown in FIG. 1 , said interior wall 15 also being tapered downwards in this section. In this way the extremity section 20 together with the floor wall 17 at the lower extremity of the sample-receiving tube 11 separates a reaction chamber 19 in which a sample 18 is filled, which is to be exposed to heat treatment by placing the sample-receiving tube 11 in a heating apparatus.

It is assumed that in the reaction chamber 19 a quantity of approx. 100 μl of sample is introduced. This quantity of sample almost fills the reaction chamber 19 completely so that when heat is applied the resulting vapor is forced to remain practically completely within the sample 18 thus preventing it from drying out.

Should only minor quantities of the sample 18—for instance only 50 μl—require treatment, the insert 14 could be replaced by a somewhat longer and more tapered insert 14 as indicated in FIG. 1 by the dashed line. In this way a much smaller reaction chamber 19' could be separated from the overall internal volume of the sample-receiving tube 11.

Due to the insert 14 being replaceable one-and-the-same lid 12 could be furnished with inserts 14 of differing length for separating reaction chambers of differing volume.

On the outer circumference of the screw cap 12 a fluted surface 21 is provided to facilitate unscrewing and screwing into place. A further fluted surface 36 is provided on the outer circumference of the top section 11' of the sample-receiving tube 11 to present added resistance for the other hand too, when unscrewing.

Functioning of the reaction vessel as described above is as follows:

With the lid 12 unscrewed and the insert 14 removed the reaction vessel first receives the sample 18 in the desired quantity in the sample-receiving tube 11. Then, depending on the quantity of sample filled, an insert 14 of suitable length is selected and inserted from underneath into the screw cap 12. The insert 14 is then introduced into the sample-receiving tube 11 so that the lid 12 can then be screwed into place on the male thread 26, during which the lid 12 must have adequate freedom of movement in axial direction so that the conical extremity section 20 of the insert 14 contacts the internal wall of the conical section (or part) 11'''' of the sample-receiving tube 11 and by turning the lid 12 further in the closing direction sufficient axial force can be produced in the direction of the arrow via the underside 37 of the lid 12 and the top edge 38 of the insert 14 to create the seal 35.

As soon as the seal 35 is produced a certain residual clearance should remain at 33.

In a top recess 39 of the lid 12 a marking label 40 is inserted.

Figure 2:
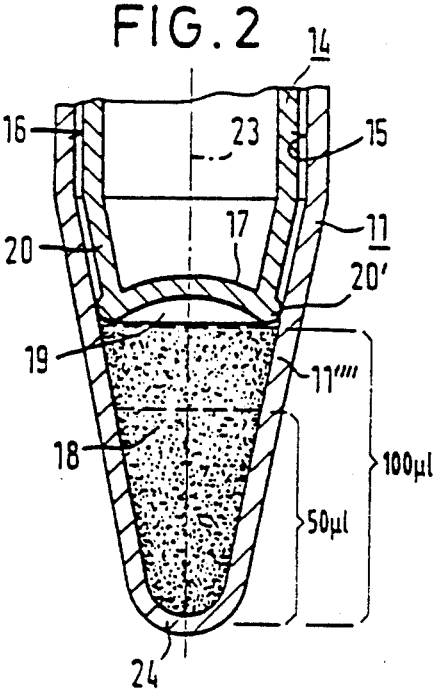
FIG. 2 is a corresponding section through the lower extremity of a reaction vessel according to the invention featuring a slightly different configuration of the seal.

In the embodiment as shown in FIG. 2 contact is made not by the complete bottom conical extremity section 20 of insert 14 with the conical internal wall of section 11'''' but merely by a lip 20' provided in the circumference of the bottom wall 17.

Since there is a distinct space between both the extremity section 20 and the circumferential lip 20' and the internal wall 15 when the insert 14 is introduced from above until it comes into contact with said internal wall 15, the reaction chamber 19 can be vented immediately prior to the seal 35 is produced thus preventing a substantial pressure build-up in the reaction chamber 19 when producing the seal 35.

Figure 3:
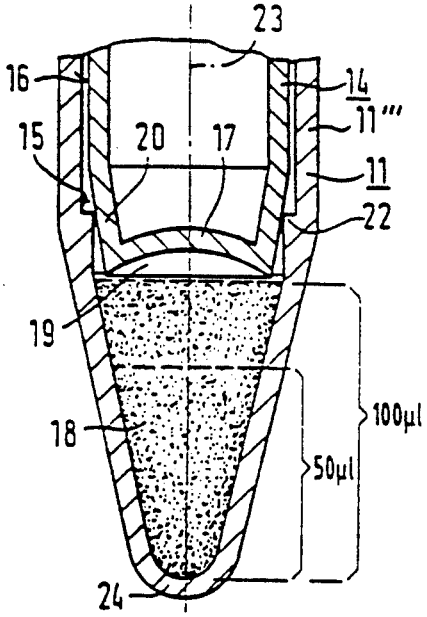
FIG. 3 is a section, similar to FIG. 2, of an embodiment operating with a graduated annular seal.

In the embodiment as depicted in FIG. 3 an annular step 22 is provided at the bottom extremity of the circular-cylindrical sector 11''' projecting inwards which acts together with the conical extremity section 20 of the insert 14 in a stuffing effect, by means of which too, the reaction chamber 19 can be separated from the remaining volume located above gas-tight.

In all embodiment examples the reference numbers refer to corresponding components.

Figure 4:
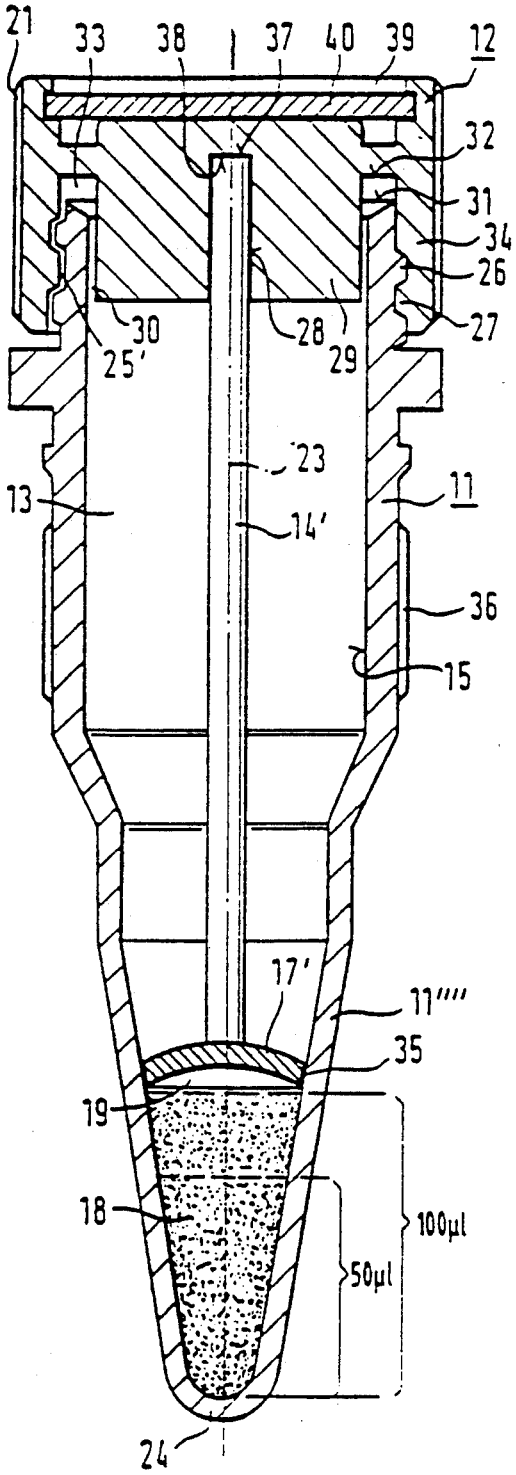
FIG. 4 is a section, similar to FIG. 1, of an embodiment of the reaction vessel featuring a rod-type insert.

The embodiment example as shown in FIG. 4 differs from that of FIG. 1 in that instead of the hollow cylindrical insert 14 a relatively thin, rod-shaped insert 14' of solid material is provided, having at its bottom extremity a sealing plate 17' which produces a seal contact 35 with the interior wall of the conical section 11'''' when the lid 12 is screwed into place. The rod-shaped insert 14' can also be separated from the lid 12 when withdrawn from the latter and, for example, be replaced by a longer or shorter insert 14'. Whilst in the embodiment example according to FIG. 1 venting is provided by a lateral borehole 25 in the lid 12, the embodiment example according to FIG. 4 a groove 25' is machined in the female thread 26, said groove providing venting of the internal space 13 via the clearance 33 and the circumferential gap 30.

Figure 5:
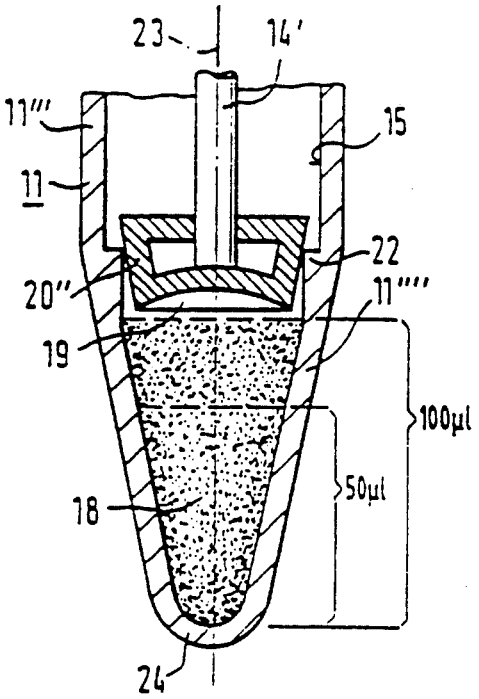
FIG. 5 is a section through the lower extremity of a reaction vessel according to FIG. 4 showing a different embodiment of the sealing elements.

Otherwise, the function is the same as in the embodiment as shown in FIG. 1. In FIG. 5 an annular step 22 can be provided—also in conjunction with a rod-shaped insert 14'—at the bottom extremity of the circular cylindrical sector 11''', said step acting together with the plug 20'' secured to the bottom extremity of said rod-shaped insert 14'.

We claim:

1. A method for reacting a given volume of a fluid sample at a temperature at which the fluid sample generates evaporation, the method comprising the steps of providing an elongated sample tube having an interior wall, a first, closed end, a second, open end and a sample tube volume, placing a given volume of fluid sample into the closed end of the tube, inserting an insert having an end portion capable of sealing said sample tube volume wherein proper alignment and such that a remainder of the insert projects from the tube and moving the end portion towards the closed end of the tube, venting a space inside the tube between the closed end and the end portion to an exterior of the tube while moving the end portion during the moving step until the end portion is in a position relative to the tube at which the closed end of the tube and a surface of the end portion proximate the closed end of the tube define a space, establishing a fluid tight, circumferential seal between the end portion of the insert and the interior wall of the tube when the end portion is at said position, thereafter holding the end portion and the tube in their relative positions in which they define said space, and reacting the fluid sample at said temperature during the holding step, whereby an escape of evaporation generated during the reacting step from said space is prevented.

2. A method according to claim 1 wherein the step of venting comprises the step of maintaining an air passage between the insert, including the end portion thereof, and the interior wall of the tube prior to the step of establishing the fluid-tight, circumferential seal.

3. A method according to claim 1 including the step of closing the open end of the tube when performing the step of establishing the fluid-tight, circumferential seal.

4. A method according to claim 3 including the step of passing air at least during the closing step through a passage in a lid or between the lid and the interior wall of the tube.

5. A method according to claim 4 wherein the step of passing comprises maintaining said passage open after the closing step has been completed.

6. A method according to claim 5 wherein the step of establishing the circumferential seal includes the step of forming opposing sealing surfaces on the interior wall and the end portion which are activated by moving the sealing surfaces against each other in an axial direction of the tube, and including the step of exerting an axially-oriented force against the circumferential seal to increase the sealing effect established thereby.

7. A method according to claim 6 wherein the step of exerting comprises the step of exerting the axially-oriented force on the end portion with the lid for the tube connected with the end portion.

* * * * *